US007134987B2

(12) United States Patent
Goldstein

(10) Patent No.: US 7,134,987 B2
(45) Date of Patent: Nov. 14, 2006

(54) PRONE FLY EXERCISE APPARATUS

(75) Inventor: Avraham Goldstein, Flushing, NY (US)

(73) Assignee: Magenav Inc., Flushing, NY (US)

( * ) Notice: Subject to any disclaimer, the term of this patent is extended or adjusted under 35 U.S.C. 154(b) by 185 days.

(21) Appl. No.: 10/841,043

(22) Filed: May 7, 2004

(65) Prior Publication Data

US 2005/0250628 A1 Nov. 10, 2005

(51) Int. Cl.
*A63B 21/00* (2006.01)

(52) U.S. Cl. ..... 482/141; 482/907

(58) Field of Classification Search ..... 482/907, 482/908, 142, 121, 123, 130, 139, 133, 141
See application file for complete search history.

(56) References Cited

U.S. PATENT DOCUMENTS 3,584,871 A * 6/1971 Kelmon et al. ..... 482/123
4,111,417 A * 9/1978 Gardner ..... 482/128
4,506,884 A * 3/1985 Hankin ..... 482/131
4,619,454 A * 10/1986 Walton ..... 482/128
5,147,266 A * 9/1992 Ricard ..... 482/131
5,295,935 A * 3/1994 Wang ..... 482/130

* cited by examiner

*Primary Examiner*—Jerome Donnelly
(74) *Attorney, Agent, or Firm*—Esther E. Schwartz

(57) ABSTRACT

A Prone Fly Exercise Apparatus comprising a hinged base portion, two inclinable arms containing parallel track means hingedly attached to the base, two handgrips that are each slidably mounted on the parallel tracks and connected to adjustable tension cords, a means for raising the parallel track containing arms to provide an incline, and a means for adjusting the tension cords. For the first exercise, the adjustable tension cords are placed between each edge of the apparatus and each handgrip. For the second exercise, the adjustable tension cords are placed between the handgrips, attaching the handgrips to each other. The apparatus is compactly foldable and easily stored.

22 Claims, 3 Drawing Sheets

PRONE FLY EXERCISE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISC

Not Applicable

BACKGROUND OF THE INVENTION (1) Field of the Invention

This invention relates to exercise equipment. More particularly, this invention relates to an apparatus designed for performing prone versions of a fly exercise and a bent-over lateral raise exercise.

(2) Description of the Related Art Including Information Disclosed Under 37 CFR 1.97 and 1.98

The current state of the art is flooded with exercise equipment tailored for specific uses. Exercise equipment has been continually improved upon, providing safer, more efficient, and more practical features.

The popular fly exercise is traditionally performed on an incline bench with free weights or in a standing position with a cable weight machine. The fly exercise is excellent for targeting most major upper body muscle groups such as the chest, tricep, shoulder, and upper back muscles.

There are several disadvantages to using and owning a traditional exercise device designed to be used to perform this exercise. First, cable weight exercise machines and free weights can be dangerous to the user and others who have contact with the equipment. Those types of equipment are not safe if there are young children with access to it. Second, all the machines in the prior art are relatively large and bulky. Third, the prior art machines can be costly. However, traditional equipment offers the significant advantage of the ability to exercise most major upper body muscle groups with a full range of motion and resistance.

Therefore, there is a need for a fly-type exercise apparatus that offers a full range of motion and resistance, but is also safer, more compact, affordable, and more convenient.

There is currently no device in the prior art that allows a fly exercise to be performed in a prone position. My invention solves the disadvantages of traditional fly exercise machines with a machine designed to allow the user to perform a fly-type exercise in a prone position. Because the machine contains no weights and folds for storage, it is inherently safer and more compact than traditional machines. The novel design allows for maximum resistance and increased range of motion. The user can alternate between the prone versions of two exercises. The apparatus is inclinable on each side to allow for greater range of motion, and is fully adjustable to allow for increased or decreased resistance. The combination of the user's position, utilizing the user's body weight, elastic resistance, and dual inclinable arms provide exercises that mimic in muscle use, form, and resistance, the traditional weight machine exercises commonly known as a fly exercise and a bent-over lateral raise.

There are several types of devices in the prior art designed to facilitate varying exercises in a prone position. However, none of these devices disclose the instant invention.

For example, U.S. Pat. No. 4,241,915 discloses a track with movable handgrips to allow the user to self-adjust the spacing between the handgrips. However, the handles are locked in place when in use. The movement of the handgrips is not intended during exercise. Elastic resistance to movement during exercising is not provided.

U.S. Pat. No. 5,518,483 discloses an exercise device to be used in a prone position. It contains two movable carriages that can be selectively stationary or free-moving with a variable resistance means. The device is intended to be used with one carriage as a knee rest and the other as a handgrip, and is designed to be used only as such. No inclinable portions are disclosed.

U.S. Pat. No. 5,295,935 discloses an exercise device containing a pair of parallel tracks with a pair of slides slidably engaged on the tracks. Resilient resistance is provided by a combination of springs and elastic bands resulting in the spring-biased poles moving toward each other and against the springs when the slides are moved away from each other. This device is adjustable to be used in varying stretching exercises, but is not designed for any weight-mimicking strength building exercises. The ends of the tracks are not inclinable, and the resistance is not user-adjustable.

U.S. Pat. No. 4,111,417 discloses an elongated frame with one set of parallel tracks extending throughout the entire frame. Two handles are set in the tracks. Three sets of compression coil springs are utilized, one placed between the handles, and the other two between each handle and the end of the frame. The springs primarily act as shock absorbers during standard push up exercises, but can be used as user-variable resistance to sliding the handles. The resistance is varied by moving the pins behind the outer ends to different selected sets of vertically aligned holes. Therefore, the resistance is not easily adjusted by the user. In addition, no means is provided to completely remove either force of resistance while exercising with the other. The track is not inclinable in any way. The apparatus is not compact and foldable. Consequently, this device cannot be used to achieve the same results and perform the same exercises as those provided by my invention. And lastly, the size and lack of mobility make it less practical and convenient.

It is therefore an object of the present invention to provide an exercise device for performing a fly exercise in a prone position.

It is a further object of the present invention to provide an exercise device for performing a prone version of a bent-over lateral raise traditionally performed with free weights.

It is a further object of the present invention to provide a device for performing both a fly exercise and bent-over lateral raise type exercise in a prone position with an apparatus that is more convenient, compact, safe, and cost-effective.

It is a further object of the present invention to provide an apparatus that combines the user's position, the user's body weight, elastic resistance, and dual inclinable arms to provide exercises that mimic in muscle use, form, and resistance, the traditional weight machine exercises commonly known as a fly exercise and a bent-over lateral raise.

BRIEF SUMMARY OF THE INVENTION

I have invented a Prone Fly Exercise Apparatus. The preferred embodiment of the apparatus comprises a hinged base portion, two inclinable arms containing parallel track means, two handgrips that are each slidably mounted on the parallel tracks and connected to adjustable tension cords, a means for raising the parallel track containing boards to provide an incline, and a means for adjusting the tension cords. For the first exercise, the adjustable tension cords are secured between the outside edge of each handgrip and the edge of the apparatus. For the second exercise, the adjustable tension cords are secured between the handgrips, attached to the inside edge of each handgrip. In the preferred embodiment, the tension cords are easily attached and removed using provided eye-hooks and corresponding hooks. In the preferred embodiment, each point of attachment contains five eye-hooks for maximum versatility. The apparatus is compactly foldable and easily stored.

DETAILED DESCRIPTION OF THE INVENTION

Figure 1:
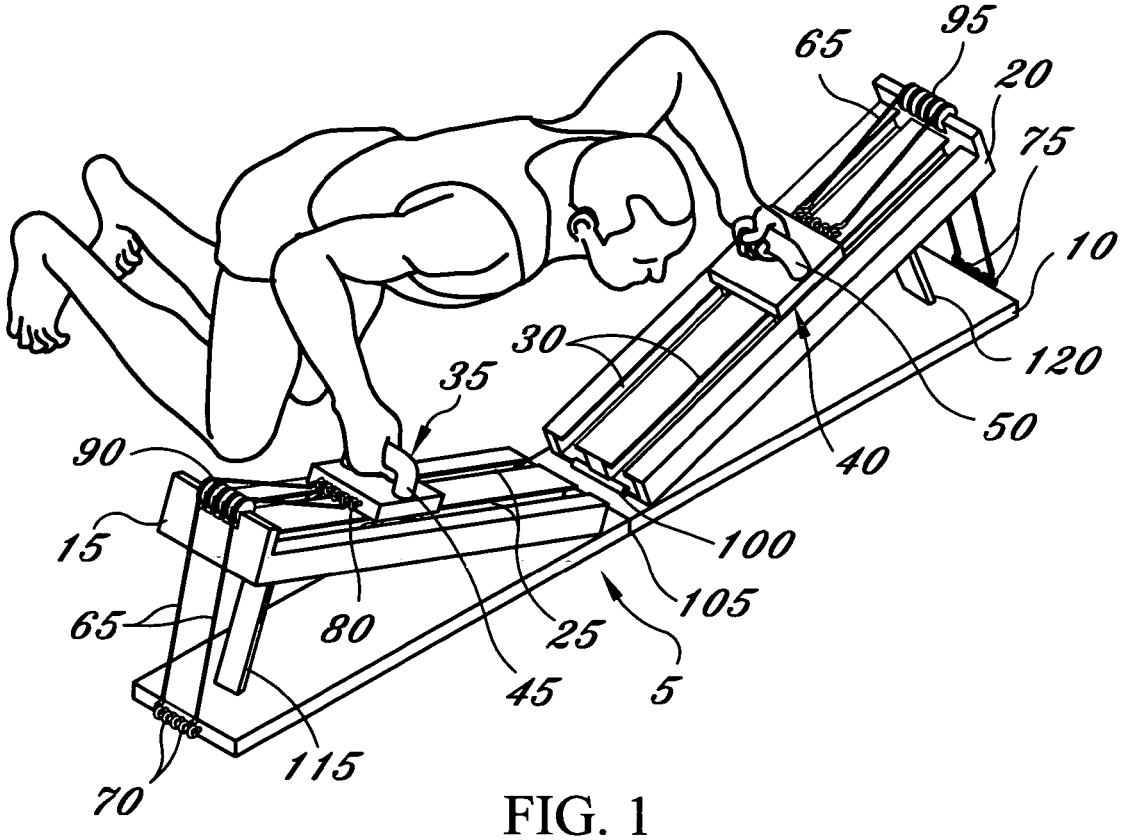
FIG. 1. is a perspective view of the apparatus as used in the first exercise.
Figure 2:
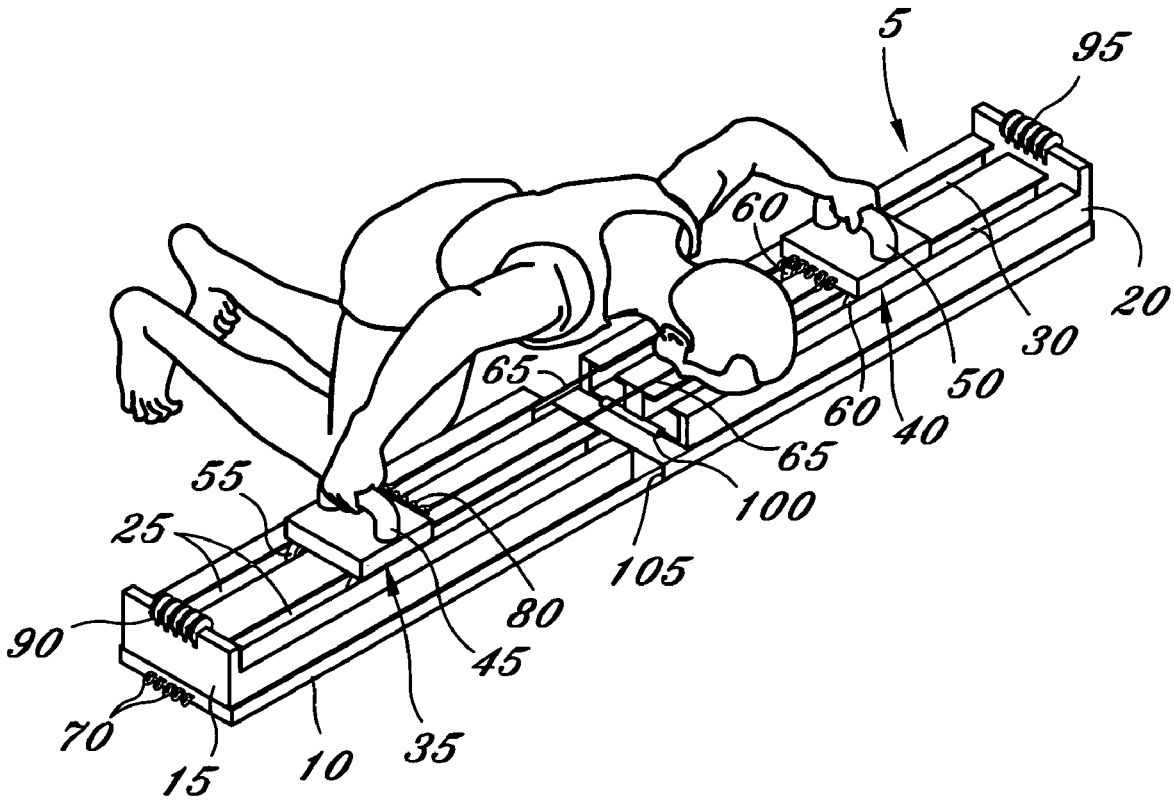
FIG. 2. is a perspective view of the apparatus as used in the second exercise.
Figure 3:
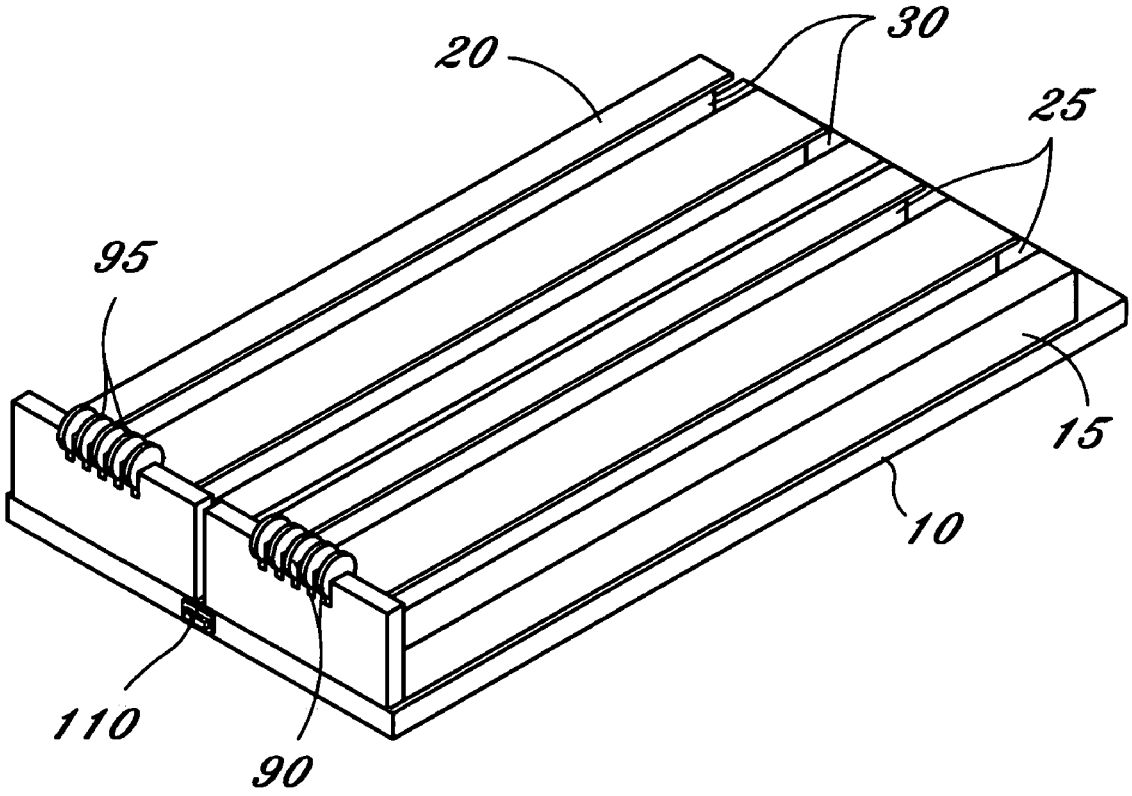
FIG. 3. is a perspective view of the apparatus in the folded, storage position.

The Prone Fly Exercise Apparatus 5, as depicted in FIGS. 1–2, generally comprises two handgrip assemblies 35, 40 slidably mounted in two sets of parallel tracks 25, 30, moved by a user against adjustable resistance provided by tension cords 65.

In the preferred embodiment, there is a base 10 to which inclinable arms 15, 20 are attached with hinges 100. The arms 15, 20 and base 10 can be integrally formed in one unit, with no separate base element. The arm elements, if not hingedly connected to a base element, are hingedly attached to each other at a center location. The base 10 and arms 15, 20 can be constructed of any durable rigid material.

In the preferred embodiment, moveable arm supports 115, 120 are provided to adjust the arms between inclined and flat positions. In the preferred embodiment, the moveable arm supports 115, 120 are permanently attached with a hinge to the underside of the arms 15, 20. The underside of the arms 15, 20 can be hollowed out to fit the arm supports 115, 120 neatly to ensure that the arms 15, 20 lay flat against the base 10 when not in the inclined position. Grooves are provided on the base 10 for the arm supports 115, 120 to be secured in firmly. Alternately, each arm support 115, 120 can have an integral means to secure it, such as rubber feet. If no separate base 10 is provided, the arm supports 115, 120 would contain an integral securing means. The moveable arm supports 115, 120 can be permanently or removably attached to the arms 15, 20, or the base 10.

In the preferred embodiment, pulley-type wheels 90, 95 are provided at the ends of the arms 15, 20 and base eye hooks 70, 75 are provided at the ends of the base 10. This allows the apparatus 5 to be more compact because the total tension cord 65 length is increased within the same space. The pulley-type wheels 90, 95 allow the tension cords 65 to be pulled over the outer edges of the arms 15, 20 without significant friction. Any other appropriate and effective means for allowing the resistance means to extend over the edges of the arms toward the base can be employed. Any removably fastenable means can be used to secure the tension cords 65 or other resistance means in the desired locations. If there is no separate base element 10, or no pulley-type wheels 90, 95, or neither, the base eye hooks 70, 75, or other removable fastening or adjusting means, are located at the end of each arm, 15, 20. The arms 15, 20 can be of any appropriate length. When no pulley-type wheels 90, 95 are employed, the arms 15, 20 will necessarily be slightly longer to allow for the length of the resistance means.

In the preferred embodiment, five base eye hooks 70, 75, five handgrip eye hooks 80, 85, and five pulley-type wheels 90, 95 are provided on each half of the apparatus 5 to allow for significant adjustment of resistance. Up to five tension cords 65 can be added or removed. The apparatus 5 will work well with less or more as well. The combination of base eye-hooks 70, 75, handgrip eye-hooks 80, 85, and tension cords 65 with attachment hooks provide a user-friendly means to self-adjust the resistance and exercise to be performed, and is much simpler and easier to use than previous variable resistance containing devices.

In the preferred embodiment, there are wheels 55, 60 on the underside of each handgrip assembly 35, 40. In the preferred embodiment, two wheels 55, 60 run in each of the parallel tracks. Therefore, there are four wheels 55, 60 on each handgrip assembly 35, 40. The handgrip assemblies 35, 40 can be slidably mounted in any effective manner.

In the preferred embodiment, the upside down u-shaped handles 45, 50 are permanently affixed at both ends to the handgrip assemblies 35, 40 in a vertical line perpendicular to the base 10. The handles 45, 50 can run in any direction or angle and be of any shape or size. The handles 45, 50 can be affixed at one or both ends. The handles 45, 50 can be constructed of any appropriate sturdy rigid material. The handles 45, 50 can be rotatable.

The tension cords 65 can be affixed to eye hooks with ordinary hooks, or any other appropriate means. The elastic resistance means can be any effective, adjustable means available.

The Prone Fly Exercise Apparatus can be compactly stored when not in use by folding the apparatus along a base midpoint hinge 105, and securing the closed apparatus with a clasp 110. A clasp can be provided to secure the open position as well.

In the preferred embodiment, the wheels 55, 60 are set in the track so that they cannot be lifted up out of the parallel tracks 25, 30, and can only move horizontally, sliding along the parallel tracks 25, 30.

When the apparatus 5 is used for the first exercise, the prone fly-type exercise, as illustrated in FIG. 1, the arms 15, 20 are inclined using the arm supports 115, 120. Two sets of tension cords 65 are hooked to the base eye hooks 70, 75 on each side of the base 10, run through the pulley wheels 90, 95, and are hooked to the handgrip eye hooks 80, 85 on the outside edge of each handgrip assembly 35, 40.

The user will perform this exercise by assuming a prone position similar to a push-up exercise position. The user will then grasp each handle 45, 50 and slide the handgrip assemblies 35, 40 toward each other. The handgrip assemblies 35, 40 will return to the at rest positions when the user stops exerting force, allowing the user to resume the starting position easily. The user will adjust the level of resistance by adding more or less tension cords 65. The user can further adjust the exercise as needed to accommodate personal preferences.

When the apparatus is used for the second exercise, as depicted in FIG. 2, tension cords 65 are hooked to the handgrip eyehooks 80, 85 on the inside edge of each handgrip assembly 35, 40, creating resistance between the handgrip assemblies 35, 40. The arms 15, 20 are not inclined, and lay flat against the base 10.

To perform the second exercise, a prone version of a bent-over lateral raise, the user will assume a similar position to that used in the first exercise. The user will then grasp each handle 45, 50 and push the handgrip assemblies 35, 40 apart, against the resistance of the tension cords 65, while remaining in the upright position. This is a different exercise than that performed with devices designed to perform enhanced push-up exercises, where the user lowers himself as the arms are moved laterally. The handgrip assemblies 35, 40 will return easily to the at rest positions when the user stops exerting force, allowing the user to resume the starting position easily. The user will adjust the level of resistance, as in the first exercise, by adding or removing tension cords 65. The user can further adjust the exercise as needed to accommodate personal preferences.

We have illustrated a preferred embodiment of the invention. However, it is to be understood that changes and variations may be made by those skilled in the art without departing from the spirit of the invention as claimed.

Many variations of the invention will occur to those skilled in the art. All such variations are intended to be within the scope and spirit of the invention. Although some embodiments are shown to include certain features, I specifically contemplate that any feature disclosed in this description may be used together or in combination with any other feature on any embodiment of the invention. I have also contemplated that any feature may be specifically excluded from any embodiment of the invention.

Further aspects of the invention will become apparent from consideration of the drawings and the description of preferred embodiments of the invention. A person skilled in the art will realize that other embodiments of the invention are possible and that the details of the invention can be modified in a number of respects, all without departing from the inventive concept. Thus, the drawings and description are to be regarded as illustrative in nature and not restrictive.

LIST OF REFERENCE NUMBERS

5. Apparatus
10. Base
15. Arm
20. Arm
25. Parallel tracks
30. Parallel tracks
35. Handgrip Assembly
40. Handgrip assembly
45. Handle
50. Handle
55. Wheels
60. Wheels
65. Tension cords
70. Base eye hooks
75. Base eye hooks
80. Handgrip eye hooks
85. Handgrip eye hooks
90. Pulley-type wheels
95. Pulley-type wheels
100. Arm hinge
105. Base midpoint hinge
110. Clasp
115. Arm support
120. Arm support

The invention claimed is:

1. An Exercise Apparatus comprising:

a. A first track assembly comprising at least one track set in a first arm;

b. A second track assembly comprising at least one track set in a second arm;

c. A first handgrip assembly slidably mounted in said first track assembly;

d. A second handgrip assembly slidably mounted in said second track assembly;

e. Said first arm and said second arm are hingedly connected to a base whereby said first arm and said second arm are laterally disposed in a horizontal line facing the user;

f. A means of adjustably inclining the outer edges of said first and second arms;

g. Pulley-type wheels are provided at said outer edges of said first and second arms;

h. A first means of resistance selectively removably attachable to the first outer edge of said base, passing over said pulley-type wheels at said outer edge of said first arm, and selectively removably attachable to the outer edge of said first handgrip assembly, a second means of resistance selectively removably attachable to the second outer edge of said base, passing over said pulley-type wheels at said outer edge of said second arm, and selectively removably attachable to the outer edge of said second handgrip assembly, and a third means of resistance selectively removably attachable between said first and second handgrip assemblies, to alternately oppose lateral movement away from the center or away from the outer edges of said first and second arms.

2. The apparatus of claim 1 in which said first and second selectively removable means of resistance pass directly over said outer edges of said first and second arms.

3. The apparatus of claim 1 in which the base is constructed of two separate hinged elements, allowing the apparatus to be folded in half.

4. The apparatus of claim 1 in which the base is constructed of two separate hinged elements, allowing the apparatus to be folded in half, and a clasp is engaged to secure the closed apparatus.

5. The apparatus of claim 1 in which the base is constructed of two separate hinged elements, allowing the apparatus to be folded in half, and a clasp is engaged to secure the apparatus in the open position.

6. The apparatus of claim 1 in which said means of adjustably inclining the outer edges of said first and second arms comprises two arm supports.

7. The apparatus of claim 1 in which said means of adjustably inclining the outer edges of said first and second arms comprising first and second arm supports hingedly connected to the undersides of said first and second arms, respectively.

8. The apparatus of claim 1 in which said base further contains first and second means to securely receive said means of adjustably inclining the outer edges of said first and second arms.

9. The apparatus of claim 1 in which said base further contains first and second grooves to securely receive said means of adjustably inclining the outer edges of said first and second arms.

10. The apparatus of claim 1 in which said first and second arms further contain a recessed portion on the underside of said first and second arms to receive said means of adjustably inclining the outer edges of said first and second arms when in an uninclined horizontal position to ensure an even surface.

11. The apparatus of claim 1 in which said first, second, and third means of resistance are tension cords.

12. The apparatus of claim 1 in which said first, second, and third means of resistance are each selectively attached and removed with a hook and eye type fastener.

13. The apparatus of claim 1 in which said first, second, and third means of resistance each comprise at least one means of resistance and are selectively attached and removed with at least one corresponding hook and eye type fastener.

14. The apparatus of claim 1 in which said first, second, and third means of resistance each comprise two or more means of resistance and are selectively attached and removed with two or more corresponding hook and eye type fasteners.

15. The apparatus of claim 1 in which said first and second handgrips each further comprise at least one discrete handle element.

16. The apparatus of claim 1 in which said first and second handgrips each further comprise a handle permanently aligned perpendicularly in relation to said first and second arms.

17. The apparatus of claim 1 in which said first and second handgrips each further comprise a handle permanently aligned horizontally in relation to said first and second arms.

18. The apparatus of claim 1 in which said first and second handgrips each further comprise a substantially upside down u-shaped handle permanently secured to the handgrip unit.

19. The apparatus of claim 1 in which said first and second handgrips each further comprise a rotatable handle.

20. The apparatus of claim 1 in which said first and second track sets each comprise two parallel tracks, and said first and second handgrip assemblies each further comprise at least two wheels on the underside of said first and second handgrip assemblies to slide along said parallel tracks.

21. The apparatus of claim 1 in which the base and arms are formed of durable material.

22. The apparatus of claim 1 in which said pulley-type wheels are replaced with eye hooks, and said first and second means of resistance are selectively removably attached to said eye hooks at said outer edges of said first and second arms.

* * * * *